US005880755A

United States Patent [19]

Fajour et al.

[11] Patent Number: 5,880,755

[45] Date of Patent: Mar. 9, 1999

[54] WIPING DEVICE FOR AN INK-JET POSTAGE METER

[75] Inventors: Michel Fajour, Chatillon; Jean-Pierre Gregoire, Brie Comte Robert, both of France

[73] Assignee: Neopost Industrie, Bagneux, France

[21] Appl. No.: 788,705

[22] Filed: Jan. 24, 1997

[30] Foreign Application Priority Data

Jan. 26, 1996 [FR] France ..... 96 00923

[51] Int. Cl.[6] ..... B41J 2/165; B41F 35/00; A46B 15/00

[52] U.S. Cl. ..... 347/33; 400/702.1; 15/256.5

[58] Field of Search ..... 347/33, 22, 23; 15/256.05; 400/701, 702, 702.1

[56] References Cited

FOREIGN PATENT DOCUMENTS

| | | |
|---|---|---|
| 0410691A1 | 1/1991 | European Pat. Off. . |
| 0416849A2 | 3/1991 | European Pat. Off. . |
| 8205426.6 | 10/1986 | Germany . |

OTHER PUBLICATIONS

Patent Abstracts of Japan, vol. 013, No. 489 (M–888), 7 Nov. 1989 corresponding to JP–A–01 195048 (Canon Inc), 4 Aug. 1989.

JP–A–02 045 156 (Alsp Electric Co Ltd) 15 Feb. 1990 (Abstract).

*Primary Examiner*—Benjamin R. Fuller
*Assistant Examiner*—Thien Tran
*Attorney, Agent, or Firm*—Sughrue, Mion, Zinn, Macpeak & Seas, PLLC

[57] ABSTRACT

A cleaning device for cleaning the outer surfaces of a row of ejection nozzles integrated in at least one print module of an ink-jet print head of a postage meter having a base including a cleaning member for wiping the ink ejection surfaces, the cleaning member being mounted on a support member which is movable, by actuating a drive member which is linked to a connecting-rod and crank system, between a first position in which the cleaning member is remote from the print module and a second position in which the cleaning member has wiped the outer surfaces of the ejection nozzles. The cleaning member is mounted on one end of a sweeping hinged lever and include a compensating support member, having respective springs, each carrying a set of independent wiping brushes, in order to transform the initial circular movement of the support member into a rectilinear movement of the brushes in contact with the ejection surfaces of the print module.

12 Claims, 4 Drawing Sheets

WIPING DEVICE FOR AN INK-JET POSTAGE METER

FIELD OF THE INVENTION

The present invention relates to a maintenance device for cleaning the print module of an ink-jet print head of a postage meter or "franking machine", and in particular it relates to a device for keeping the ejection surfaces of at least one row of nozzles of said print module in condition by wiping them.

PRIOR ART

In the field of postage meters, ink-jet technology raises the critical problem of the quality of the impression provided by the print module, i.e. by the ejection nozzles of the print head incorporating said module. Without special protection, the nozzles are exposed, in particular to the air, which can cause the ink contained in the print module to dry. Unfortunately, the quality of the impression is particularly essential in the field of mail processing where the printed postage imprint represents a monetary value.

OBJECT AND BRIEF SUMMARY OF THE INVENTION

An object of the present invention is to propose a maintenance device which enables the ejection nozzles of the print head of a postage meter to be cleaned regularly so as to clear the nozzles of possibly-dry ink particles or dust which might cover the ends thereof and thus reduce their effectiveness. Another object of the invention is to propose a device which fits very simply on a base of the postage meter. Yet another object of the invention is to provide a device which can be implemented in combination with a protection device for protecting the print module which has also been developed by the Applicant and which is the subject of a patent application filed on the same day.

These objects are achieved by a cleaning device for cleaning the outer surfaces of a row of ejection nozzles integrated in at least one print module of an ink-jet print head of a postage meter having a base including cleaning means for wiping the ink ejection surfaces, wherein the cleaning means comprises compensating support means, having respective springs, each carrying a set of independent wiping brushes, and are mounted on one end a sweeping hinger lever which can be moved, by actuating drive means, via means of a connecting-rod and crank system, between a first position in which the cleaning means are remote from the print module and a second position in which the cleaning means have wiped the outer surfaces of the ejection nozzles, the initial circular movement of said sweeping hinged lever being transformed into a rectilinear movement of the brushes in contact with the ejection surfaces of the print module.

The simplicity of the system employed which allows the cleaning device to be integrated directly in the base of a postage meter without significantly complicating its architecture, enables very effective preventative maintenance to be performed by periodically cleaning the head, resulting in a noticeable improvement in the print quality which is of the utmost importance in the field of mail processing.

In addition, each set of brushes includes an active end surface with two sharp edges to allow the ejection surfaces of the print module to be wiped while the support means are moved from said first position to said second position and vice versa.

The vertical plane passing via a hinged axis of the sweeping lever is preferably inclined by a predetermined angle a relative to the longitudinal plane of a row of ejection nozzles of the print module, so that each individual brush belonging to a given set of brushes wipes one and only one nozzle of a predetermined row.

The connecting-rod and crank system is formed firstly by a rod connected to the other end of the hinged sweeping lever and secondly by a Maltese cross driven in rotation by a drive shaft which is itself driven in rotation by the drive means. The Maltese cross is driven by drive means via a toothed drive wheel mounted on the drive shaft and a set of gear wheels connecting said drive wheel to the drive means.

The drive means include either first energy-storing drive means formed by a spring which is stretched while the support means are moved from said first position to said second position and is released while the support means returns from said second position to said first position, or second drive means which controls movement of the support means from said first position to said second position, and simultaneously ensures that the first drive means is reloaded with energy.

The cleaning device of the invention may further includes a cam mounted on the drive shaft, driven in rotation therewith, and which cooperates with retaining means for retaining the support means in said first position. The retaining means for retaining the support means in said first position include a pawl cooperating with a shoulder of the cam and actuated by an electromagnet which is deactivated automatically when the power supply to the postage meter is cut. The pawl is controlled by the electromagnet by means of a link.

The invention also relates to any postage meter provided with an ink-jet print head and a base including a cleaning device such as described above.

BRIEF DESCRIPTION OF THE DRAWING

Other characteristics and advantages of the present invention appear further from the following description given by way of non-limiting indication and with reference to the accompanying drawings, in which.

DETAILED DESCRIPTION OF A PREFERRED EMBODIMENT

Figure 1:
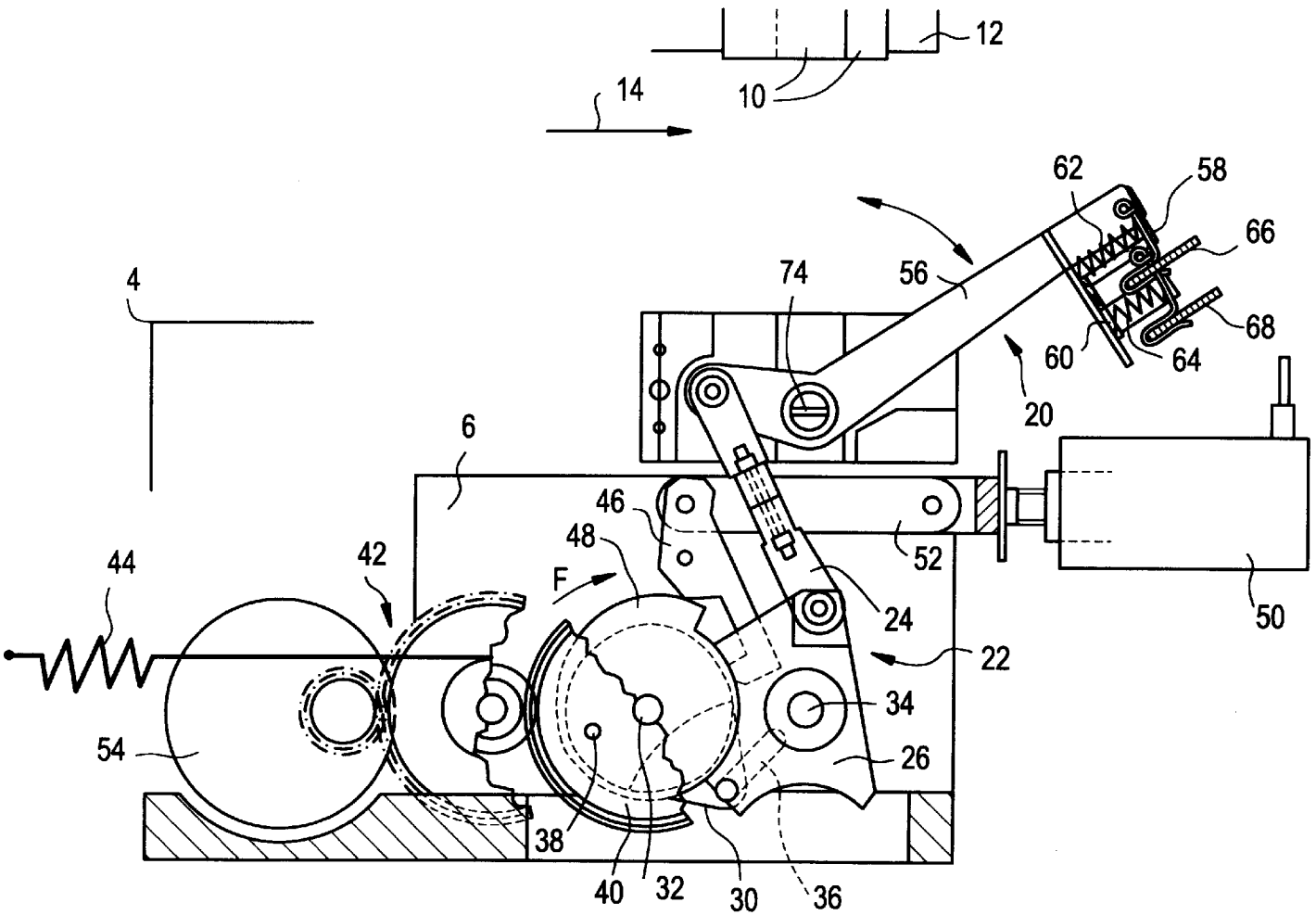
FIG. 1 is a cross-section view of the cleaning device of the invention in a disengaged initial position during normal operation of the postage meter.
Figure 2:
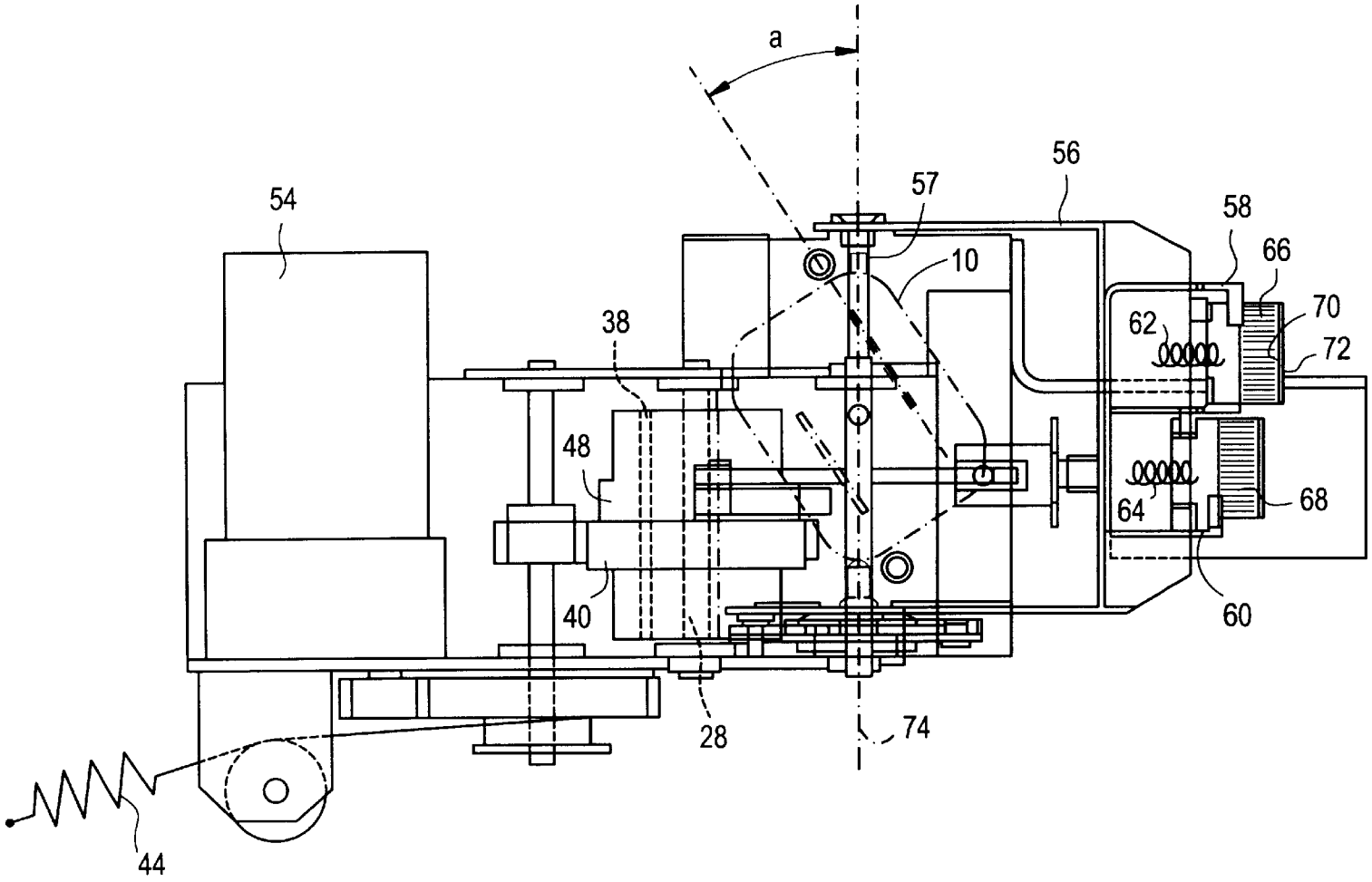
FIG. 2 a fragmentary view from above of the cleaning device of FIG. 1.
Figure 3:
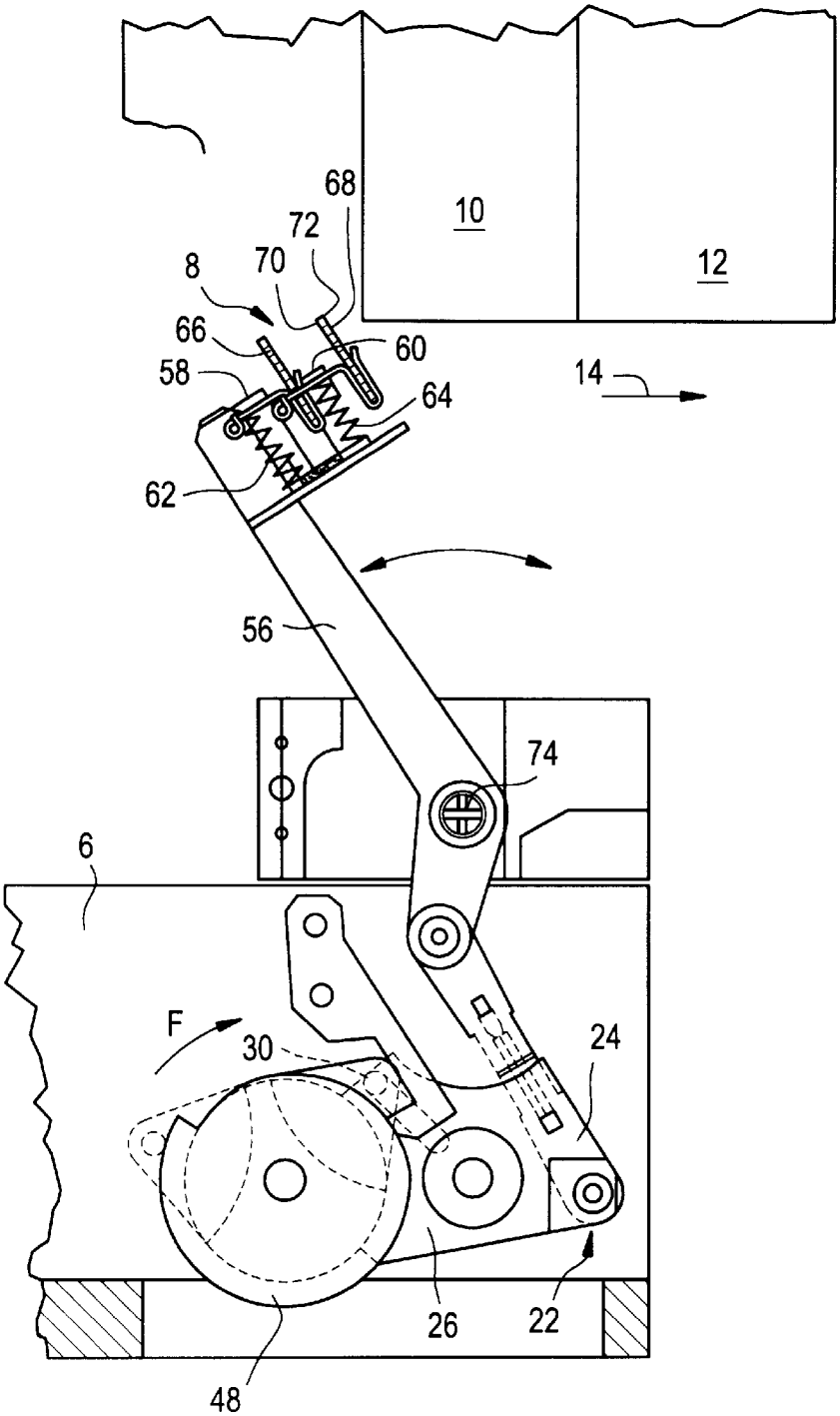
FIG. 3 is a cross-section view of the cleaning device of the invention in a final position after wiping the print module of the postage meter by cleaning means.

Consideration is given initially to FIGS. 1 to 3 which show a cleaning device of the invention in two distinct positions of operation. The device 2 incorporated in a base 4 of a postage meter includes a body 6 on which cleaning means 8 can be mounted, the cleaning means being designed to clean a print module 10 of an ink-jet print head 12 of the postage meter by wiping it. In FIGS. 1 and 2, the cleaning means 8 occupy an initial position disengaged from a document travel path 14.

The cleaning means are mounted on support means 20 which, by means of a connecting-rod and crank drive system 22, can be moved along a main circular path (described in greater detail in FIG. 4), from the initial position to a final position in which the cleaning means have begun to wipe the print module. The connecting-rod portion of said system is constituted by a rod 24, of a length which can be adjusted as a function of the displacement distance desired for the cleaning means and having a first end fixed to the support means 20, while the crank portion thereof, which is hinged to a second end of the rod, is constituted by a Maltese cross 26 of a conventional "Maltese cross" assembly also including a drive shaft 28 on which there are mounted a brake disk and a drive disk fitted with an excentric peg or stud 30, and whose axis of rotation 32 is parallel to the axis of rotation 34 of the Maltese cross. Sliding the stud 30 in a radial groove 36 of one of the arms of the Maltese cross 26 allows the Maltese cross to be driven over only a fraction of a turn while the drive disk performs a complete rotation. The drive disk which is secured by a pin 38 to a toothed drive wheel 40 is itself driven in rotation, through a set of gear wheels 42, either during displacement from said second position to said first position by a first drive means 44 constituted by a simple reloadable energy storage means such as an elastic element or even a suspended mass, or else during displacement from said first position to said second position by a second drive means 54 (see FIG. 2 in particular).

The drive wheel 40 can be held in a predetermined position corresponding, for example, to the initial position of the cleaning means by retaining means formed by a pawl 46 engaging a shoulder associated with a cam 48 secured to said wheel. The pawl 46 is released by an electromagnet 50 which acts on a link 52 secured to said pawl.

The support means 20, on which the cleaning means 8 are disposed include a U-shaped hinged sweeping lever 56, and at the upper end of which the compensating support means 58, 60 are mounted (one per row of ejection nozzles) having respective springs 62, 64 each carrying a set of independent wiping brushes 66, 68, the corresponding active end surface of which includes two sharp edges 70, 72 to enable wiping to be performed in both displacement directions of the support means. It can be seen that the vertical plane passing via the hinged axis 74 of the lever 56 is advantageously inclined by an angle a relative to the longitudinal plane of the rows of ejection nozzles of the print module 10, so that each individual brush belonging to a given set of brushes wipes one and only one nozzle of a predetermined row.

Figure 4:
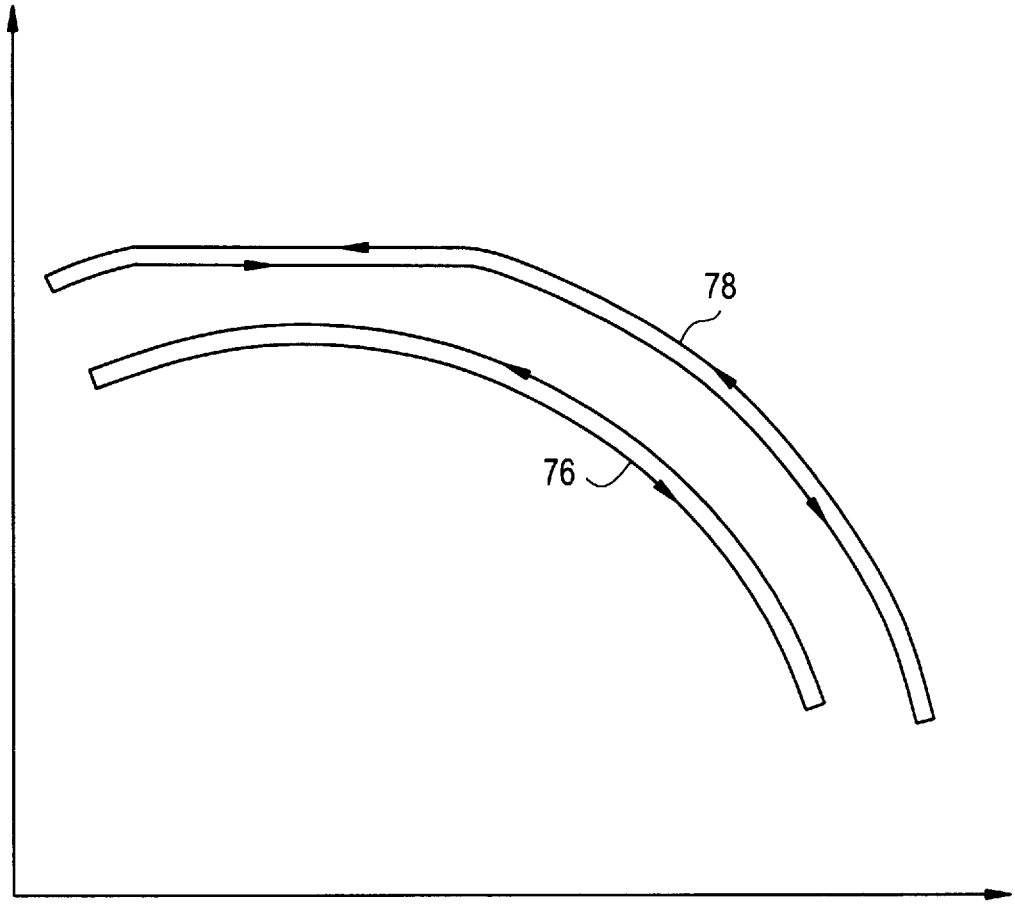
FIG. 4 shows two graphs corresponding respectively e paths of two points of a sweeping means of the device of FIG. 1.

The compensating means are designed to transform the circular movement of the active ends 70, 72 of the wiping brushes into a rectilinear movement, parallel with the ejection surfaces of the nozzles, while the brushes are in contact with the outside surfaces of the nozzles so that the brushes are not crushed and thus retain their maximum wiping effectiveness. FIG. 4 shows this transformation of the movement by means of two graphs 76, 78, which respectively show, for a go-and-return movement of the support means 20, the paths followed by the positions of the end points of the support 58 and the path of the active end of a brush 66 mounted on said support.

The operation of the device is described below.

To start the cleaning stage of the print module of the postage meter, the second drive means 54 is actuated, driving the cam 48 in a anticlockwise direction while simultaneously loading the drive spring 44. During rotation, the cam associated with the peg 30 drives the Maltese cross 26 which, by means of the rod 24, actuates the hinge lever 56 causing the cleaning means 8 to pivot from the disengaged initial position to the active final position after wiping the print module. End of stroke means (not shown) is naturally provided in order to detect the final position and thus request the second drive means 54 to stop. Precisely from that moment, the drive spring 44 can be released, causing the rod 24 and the hinge lever 56 to reverse the previous movements, i.e. rotating the cam 48 in the opposite direction which brings the Maltese cross 26 into its first position and thus also brings the cleaning means 8 to its first position. The return position is naturally limited by the release of the spring 44 which returns to its initial rest position. However, it is possible to limit said release and maintain an inner tension in the spring via the retaining means, in particular the pawl 46, which can thus impose a predetermined disengaged position.

Furthermore, to enable the maintenance device of the invention to be used in conjunction with the capping device developed by the Applicant, the drive spring 44 is preferably initially stretched. Thus, in the disengaged position of FIG. 1, the electromagnet 50 pulls the pawl 46 continuously by means of the link 52, which prevents the cam 48 from rotating in the direction F and thus fixes the initial position of the cleaning means 8. In this case, the start of the cleaning stage previously described will cause additional tension from the spring 44. However, when the power supply to the postage meter is unexpectedly cut or when the postage meter is voluntarily switched off, deactivation of the electromagnet 50 causes the pawl 46 to disengage and the cam 48 to rotate in a clockwise direction as a result of the drive spring 44 returning to a more relaxed position. It can be seen in FIG. 1, however, that this rotation has no effect on the position of the Maltese cross which remains stationary.

In addition, it can be noted that the nozzles are wiped by the edges 70 during the go-path (from the disengaged position to the active final position) and by the edges 72 during the return-path (from the active final position to the disengaged position).

Naturally, the person skilled in the art is able to implement additional means, not described in detail, which are necessary for limiting sudden movements of the hinge lever 56 or excess current in the second drive means 54, particularly when it is stopped. A "recovery" diode can be used, for example, in association with the second drive means 54 in order to eliminate any risk of excess current when the drive means 54 is stopped. Possible sudden abutment of the brushes against the outer surfaces of the nozzles can thus be avoided by controlling the return speed of the hinge lever.

We claim:

1. A cleaning device for cleaning outer surfaces of a row of ejection nozzles integrated in at least one print module of an ink-jet print head of a postage meter having a base by wiping the outer surfaces of the ejection nozzles, wherein the cleaning device comprises:

a movable hinged sweeping lever including a first end and a second end;

a plurality of sets of independent wiping brushes mounted on said first end of said hinged sweeping lever;

compensating support means, connected to said hinged sweeping lever and said sets of independent brushes, for transforming the movement of said brushes from an initial circular movement imparted by said hinged sweeping lever into a rectilinear movement of the brushes when in contact with the ejection surfaces of the print module, wherein said compensating support means includes respective springs, each carrying a set of said independent wiping brushes;

a connecting-rod and crank system; and an actuating drive means, linked to said connecting-rod and crank system, for moving said hinged sweeping lever and said support means between a first position in which the brushes are remote from the print module and a second position in which the brushes have wiped the outer surfaces of the ejection nozzles.

2. A cleaning device according to claim 1, wherein each set of brushes includes an active end surface with two sharp edges for wiping the ejection surfaces of the print module while the support means is are moved from said first position to said second position and vice versa.

3. A cleaning device according to claim 1, wherein the vertical plane passing through hinged axis of the sweeping lever is inclined by a predetermined angle to the longitudinal plane of a row of ejection nozzles of the print module, so that each individual brush belonging to a given set of brushes wipes one and only one nozzle of a predetermined row.

4. A cleaning device according to claim 1, wherein the connecting-rod and crank system is formed firstly by a rod connected to said second end of the hinged sweeping lever and secondly by a Maltese cross driven in rotation by a drive shaft which is driven in rotation by the drive means.

5. A cleaning device according to claim 4, further comprising a toothed drive wheel mounted on the drive shaft and a set of gear wheels connecting said drive wheel to the drive means.

6. A cleaning device according to claim 1, wherein the drive means includes a first drive means for storing energy wherein said first drive means is formed by a spring which is stretched while the support means is moved from said first position to said second position and is released while the support means returns from said second position to said first position.

7. A cleaning device according to claim 6, wherein the drive means includes a second drive means for controlling movement of the support means from said first position to said second position, and simultaneously for ensuring that the first drive means is reloaded with energy.

8. A cleaning device according to claim 1, further including a cam mounted on the drive shaft, driven in rotation therewith, and which cooperates with retaining means for retaining the support means in said first position.

9. A cleaning device according to claim 8, wherein the retaining means for retaining the support means in said first position includes a pawl cooperating with a shoulder of the cam and is actuated by an electromagnet which is deactivated automatically when a power supply of the postage meter is cut.

10. A cleaning device according to claim 9, wherein the pawl is connected to the electromagnet by a link.

11. A postage meter comprising:

a base;

an ink-jet print head mounted adjacent said base, said ink let print head including a row of election nozzles having outer surfaces; and a cleaning device connected to said base, wherein said cleaning device includes:

a movable hinged sweeping lever including a first end and a second end;

a plurality of sets of independent wiping brushes mounted on said first end of said hinged sweeping lever;

compensating support means, connected to said hinged sweeping lever and said sets of independent brushes, for transforming the movement of said brushes from an initial circular movement imparted by said hinged sweeping lever into a rectilinear movement of the brushes when in contact with the election surfaces of the print module, wherein said compensating support means includes respective springs, each carrying a set of said independent wiping brushes; and a connecting-rod and crank system, an actuating drive means, linked to said connecting-rod and crank system, for moving said hinged sweeping lever and said support means between a first position in which the brushes are remote from the Print module and a second position in which the brushes have wiped the outer surfaces of the election nozzles.

12. A cleaning device, for cleaning outer surfaces of a row of ejection nozzles integrated in at least one print module of an ink-jet print head of a postage meter having a base, comprising:

a movable hinged sweeping lever including a first end and a second end;

a plurality of sets of independent wiping brushes mounted on said first end of said hinged sweeping lever;

a plurality of springs, wherein respective springs each connects one of said set of independent wiping brushes to said hinged sweeping lever, said springs connecting a respective set of wiping brushes being arranged to be compressed when said wiping brushes contact the ejection surface of the print module thereby transforming the movement of said respective set of wiping brushes from an initial circular movement imparted by said hinged sweeping lever into a rectilinear movement;

a connecting-rod and crank system, and an actuating drive member connected to said hinged sweeping lever by said connecting-rod and crank system such that said actuating drive member moves said hinged sweeping lever and said plurality of sets of independent wiping brushes between a first position in which the brushes are remote from the print module and a second position in which the brushes have wiped the outer surfaces of the ejection nozzles.

* * * * *